US007866380B2

(12) United States Patent
Masters et al.

(10) Patent No.: US 7,866,380 B2
(45) **Date of Patent: *Jan. 11, 2011**

(54) SYSTEM AND METHOD FOR PRODUCING HOT WATER WITHOUT A FLAME

(75) Inventors: W. James Masters, Trophy Club, TX (US); Douglas W. Fugate, Flower Mound, TX (US); Edwin E. Wilson, Grand Prairie, TX (US); John T. Johnson, III, Arlington, TX (US); W. Jason Masters, Grapevine, TX (US)

(73) Assignee: OmniTherm, Inc., Flower Mound, TX (US)

( * ) Notice: Subject to any disclaimer, the term of this patent is extended or adjusted under 35 U.S.C. 154(b) by 1132 days.

This patent is subject to a terminal disclaimer.

(21) Appl. No.: 11/398,828

(22) Filed: Apr. 5, 2006

(65) Prior Publication Data

US 2006/0260788 A1 Nov. 23, 2006

Related U.S. Application Data

(60) Provisional application No. 60/668,541, filed on Apr. 5, 2005.

(51) Int. Cl.
*F28B 1/00* (2006.01)

(52) U.S. Cl. ..... 165/200; 210/748.01; 210/739; 210/600; 60/645; 60/670

(58) Field of Classification Search ..... 210/600, 210/748, 749; 60/645, 670
See application file for complete search history.

(56) References Cited

U.S. PATENT DOCUMENTS

| | | | | |
|---|---|---|---|---|
| 2,908,331 | A * | 10/1959 | Brown | 166/61 |
| 5,279,262 | A * | 1/1994 | Muehleck | 122/26 |
| 2002/0050478 | A1 * | 5/2002 | Talbert et al. | 210/742 |
| 2003/0070430 | A1 * | 4/2003 | Beckius et al. | 60/645 |
| 2007/0261823 | A1 * | 11/2007 | Masters et al. | 165/110 |

FOREIGN PATENT DOCUMENTS

WO WO 9964112 A1 * 12/1999

OTHER PUBLICATIONS

Island City, LLC specification for Dynamic Engine Heater, model A2R1163 VN.

* cited by examiner

*Primary Examiner*—Walter D Griffin
*Assistant Examiner*—Cameron J Allen
(74) *Attorney, Agent, or Firm*—Daniel J. Chalker; Edwin S. Flores; Chalker Flores, LLP

(57) ABSTRACT

The present invention provides a system and method for producing hot water without a flame. The system and method heats water to at least a specified temperature without a flame by providing a source of water and a prime mover, pumping water from the source of water into one or more heat exchangers, pre-heating the water using the one or more heat exchangers, heating the pre-heated water to at least the specified temperature without a flame using a dynamic heat generator driven by the prime mover, using the heated water in the one or more heat exchangers to pre-heat the water and providing the heated water to an output.

27 Claims, 5 Drawing Sheets

SYSTEM AND METHOD FOR PRODUCING HOT WATER WITHOUT A FLAME

FIELD OF THE INVENTION

The present invention relates generally to the field of heating liquids and, more particularly, to a system and method apparatus for producing hot water without a flame.

PRIORITY CLAIM

This patent application is a non-provisional application of U.S. provisional patent application 60/668,541 filed on Apr. 5, 2005 and entitled "Flameless Hot Water System and Method," which is hereby incorporated by reference in its entirety.

BACKGROUND OF THE INVENTION

One of the most pressing needs throughout the world is drinkable water. An untold number of humans die every year because the water they consume is contaminated. In some areas, people are forced to spend a great deal of time manually hauling water from a distant source to their homes and villages rather than taking the risk of drinking untested water that might be nearby.

There are many methods of purifying water. One of the most common is reverse osmosis (RO). This process has been around for a long time, but it has its drawbacks. Although RO systems can be inexpensive, there is an ongoing maintenance requirement of filter replacement. Filters in RO systems can become clogged and/or damaged by constant exposure to the water source being purified. Cost and availability of replacement filters and the skill level to perform this maintenance requirement can present a problem.

Another method of water purification includes adding chemicals to the water to kill pathogens. Generally, chemical applications are used for situations where small amounts of water need purification. Although effective when the proper concentrations of chemicals are used, it is difficult to always measure the proper amounts. In addition, this system of purification does not address problems with heavy metals that may be present in water.

Boiling water is another way of killing pathogens in water. Unfortunately, in many parts of the world where contaminated water is a major problem, the availability of materials to heat water, such as wood, does not exist.

In particular areas or industries, hot water and/or steam may be needed, but it may be critical that no open flames be used to heat the water. One such industry is the oil field service industry. In many geographical regions oil reservoirs are found to contain high concentrations of paraffin, a waxy crystalline hydrocarbon. This substance, while commercially useful in the manufacture of coatings, sealants, candles, rubber compounding, pharmaceuticals and cosmetics, can present a problem with regard to the production of oil. Paraffin suspended in the crude oil tends to clog perforations in the oil well's production string and slows the flow of crude oil to the surface.

Several technologies have been in use for many years to minimize the detrimental effects of paraffin. Among these is injecting hot water, steam or chemical solvents into the well to clean out the wells perforations by liquefying the paraffin either by heating it above its melting point or chemically changing its composition. While effective, all of these have their shortcomings.

When the hot water method is employed, water must be transported to the well site then heated in a LPG or diesel fired boiler mounted either on a truck chassis or trailer. Availability of water at the well site is a common problem, and unsafe conditions exist when an open flame, like those used to heat water or crude in the boiler tanks, is positioned near the wellhead where there may be a high concentration of natural gas in the atmosphere.

The steam method usually entails the building of a power plant utilizing the field's natural gas to produce electricity and piping the waste steam to various wellheads for injection. While this eliminates the open flame close to the wellhead, it can involve a large capital expenditure that may become economically viable only when there is a large concentration of wells in a relatively small area. Piping steam to isolated outlying wells is sometimes not viable because too much heat may be lost before the steam gets to the wells. This may cause only distilled water to be delivered to the wellhead.

The chemical solvent method locates a container of solvent near the wellhead, and then injects it down hole with each stroke of the well's pumping unit. While this method eliminates open flames near the wellhead and does not require large capital expenditures, it does add substantial cost to the operation. The chemicals are expensive, costs associated with the transportation and handling of hazardous chemicals is expensive, and the addition of these chemicals to the crude oil makes the refining process more expensive.

SUMMARY OF THE INVENTION

The present invention provides a flameless hot water system and method that substantially eliminates or reduces at least some of the disadvantages and problems associated with previous systems and methods. Particular embodiments include a water purification system designed to heat water in excess of 212 degrees Fahrenheit using a heater driven by an engine, a turbine, an electric motor, a hydraulic motor or a combination thereof. The process can reach hot temperatures in a short period of time, generally under five minutes, and can, sustain a constant flow of water at those temperatures. The system typically requires no flames to heat the water, thereby making it safe in environments that may be subject to flammable materials such as hydrocarbons or gases. It can also be adapted to desalinate water by producing pure steam.

More specifically, the present invention provides a method for heating water to at least a specified temperature without a flame by providing a source of water and a prime mover, pumping water from the source of water into one or more heat exchangers, pre-heating the water using the one or more heat exchangers, heating the pre-heated water to at least the specified temperature without a flame using a dynamic heat generator driven by the prime mover, using the heated water in the one or more heat exchangers to pre-heat the water and providing the heated water to an output. The specified temperature can be greater than or equal to 212 degrees Fahrenheit, greater than a temperature required to kill pathogens within the water, greater than or equal to 250 degrees Fahrenheit, greater than or equal to 300 degrees Fahrenheit, greater than or equal to a temperature required to desalinate saltwater, greater than or equal to a temperature required to melt paraffin, greater than or equal to a temperature required to create steam, or any other desired temperature. The method may also include steps to substantially remove solids from the water, filter the water before pre-heating the water, filter the heated water before providing the heated water to the output, controlling the specified temperature by adjusting a flow rate of the water through the dynamic heat generator, storing the heated water, circulating the heated water, etc.

In addition, the present invention provides a system for heating water to at least a specified temperature without a flame using a prime mover, a pump, a dynamic heat generator and one or more heat exchangers. The dynamic heat generator is driven by the prime mover to heat the water to a least the specified temperature without a flame. The one or more heat exchangers are connected to the pump and the dynamic heat generator such that the heated water from the dynamic heat generator is provided to an output and is used to pre-heat the water from the pump before the water is heated by the dynamic heat generator.

Moreover, the present invention provides a system for desalinating saltwater using a prime mover, a closed loop (dynamic heat generator, a first pump and a first heat exchanger), a second pump and a hydrocyclone. The dynamic heat generator is driven by the prime mover to heat a heat transfer liquid to a least the specified temperature without a flame. The first heat exchanger connected to the second pump such that such that the heated heat transfer liquid from the dynamic heat generator is used to heat the saltwater from the second pump. The hydrocyclone is connected to the first heat exchanger, receives the heated saltwater and substantially separates the heated saltwater into desalinated water and a salt slurry.

The present invention also provides a system for melting paraffin in an oil well using a prime mover, a water storage unit, a dynamic heat generator and a valve. The dynamic heat generator is driven by the prime mover and is connected to or disposed within the water storage unit to heat the water to a least a specified temperature without a flame. The valve connects the dynamic heat generator to the water storage unit and the oil well such that the heated water is circulated to the water storage until the heated water in the water storage reaches a temperature sufficient to melt the paraffin and the heated water is pumped into the oil well.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

The above and further advantages of the invention may be better understood by referring to the following description in conjunction with the accompanying drawings, in which.

DETAILED DESCRIPTION OF THE INVENTION

Figure 1:
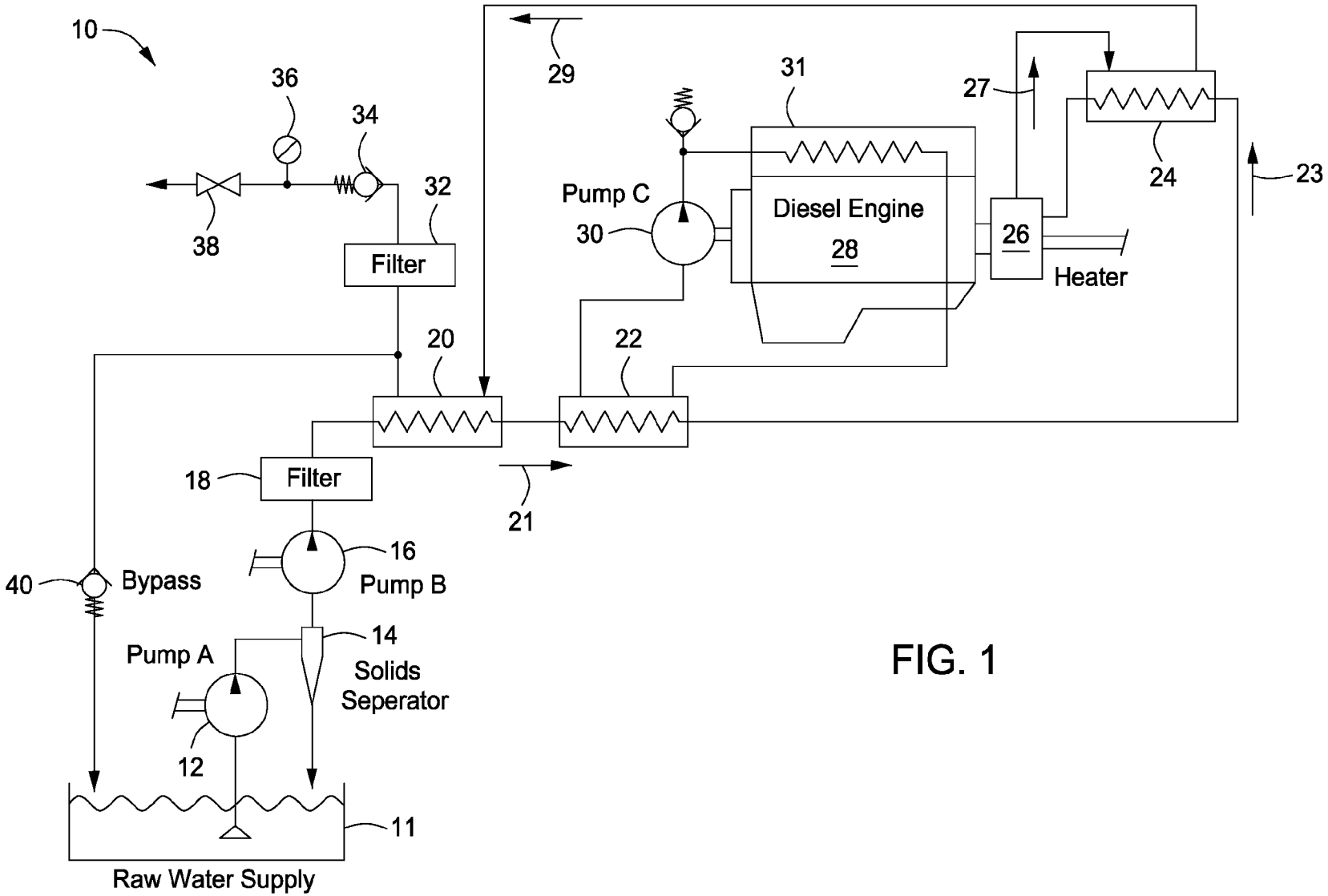
FIG. 1 illustrates a flameless hot water system for killing pathogens and other contaminants, in accordance with a particular embodiment.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. The discussion herein relates primarily to heating water, but it will be understood that the concepts of the present invention are applicable to any system and method for heating liquids without using open flames for killing pathogens in water, distilling water, producing radiant heat, melting paraffin in oil wells, and steam reforming of petroleum fuels for the production of hydrogen for use in fuel cells.

The ability to heat water above 212 degrees Fahrenheit, to kill pathogens without the need of an open flame, makes this system adaptable to all types of locations and environments. In addition, particular embodiments can be adapted for the distillation of salt water. Particular embodiments are capable of performing additional applications for hot water and/or steam and at the same time are capable of reducing safety issues that are associated with other applications.

More specifically, the present invention provides a method for heating water to at least a specified temperature without a flame by providing a source of water and a prime mover, pumping water from the source of water into one or more heat exchangers, pre-heating the water using the one or more heat exchangers, heating the pre-heated water to at least the specified temperature without a flame using a dynamic heat generator driven by the prime mover, using the heated water in the one or more heat exchangers to pre-heat the water and providing the heated water to an output. The dynamic heat generator may be similar or identical to devices provided by Island City, LLC and typically includes a stationary housing having an input, an output, and a first set of radial vanes within the stationary housing, and a rotor disposed within the stationary housing having a second set of radial vanes. The specified temperature can be greater than or equal to 212 degrees Fahrenheit, greater than a temperature required to kill pathogens within the water, greater than or equal to 250 degrees Fahrenheit, greater than or equal to 300 degrees Fahrenheit, greater than or equal to a temperature required to desalinate saltwater, greater than or equal to a temperature required to melt paraffin, greater than or equal to a temperature required to create steam, or any other desired temperature.

The method may also include steps to: (1) substantially remove solids from the water using one or more filters, one or more screens, a hydrocyclone or a combination thereof; (2) filtering the water before pre-heating the water; (3) filtering the heated water before providing the heated water to the output; (4) controlling the specified temperature by adjusting a flow rate of the water through the dynamic heat generator; (5) storing the heated water; or (6) circulating the heated water. The heated water can then be used to produce electricity, provide radiant heat, provide drinking water, melt paraffin in an oil well, produce steam, produce steam to reform a petroleum fuel to produce hydrogen for use in a fuel cell, or any other use that requires hot water.

As will be shown in particular embodiments described below, water is pumped from its source using a diaphragm pump or mechanical pump that can be adjusted to control the flow of intake. If necessary, a hydrocyclone can be placed between the water source and the dynamic heat generator to remove solid debris down to approximately three microns. This prevents larger debris from entering the dynamic heat generator. The water is then run through the inside of a heat transfer unit that has the engine block water running on the outside of the unit. This step increases the efficiency of the process by preheating the water. The preheated water then flows to the dynamic heat generator. Until the water reaches the desired temperature, it continues in a loop back to the water source. As the water temperature exceeds 212 degrees Fahrenheit or other specified temperature, a thermostat device opens and the non-contaminated water is released into a holding tank.

Particular embodiments can be trailer mounted or permanently placed and may be set up in remote areas or disaster locations where potable water is necessary for survival. One aspect of the system is a dynamic heat generator that, when coupled to a power source such as a small diesel engine or electrical motor, can produce in minutes a constant flow of water in excess of 212 degrees Fahrenheit. In some embodiments, no open flames or heating elements are required to heat water to this temperature or higher. In addition, the system has the ability to produce electricity for lighting, by adding a generator set to the system, and radiant heat for warming homes or buildings.

When salt water treatment is required, the water that has reached a temperature of 212 degrees Fahrenheit may be run through a hydrocyclone causing a vacuum which then flashes the water to steam. At that point, the salt is separated from the water and the concentrated salt brine falls through the bottom of the hydrocyclone while the pure steam escapes and flows through a heat exchanger that condenses it back to a liquid form.

In addition, the present invention provides a system for heating water to at least a specified temperature without a flame using a prime mover, a pump, a dynamic heat generator and one or more heat exchangers. The dynamic heat generator is driven by the prime mover to heat the water to a least the specified temperature without a flame. The one or more heat exchangers are connected to the pump and the dynamic heat generator such that the heated water from the dynamic heat generator is provided to an output and is used to pre-heat the water from the pump before the water is heated by the dynamic heat generator. The prime mover can be an engine, a turbine, an electric motor, a hydraulic motor or a combination thereof. As will be described below in reference to FIG. 1, the system may also include: (1) a first filter connected between the pump and the one or more heat exchangers; (2) a second filter connected between the one or more heat exchangers and the output; (3) a solids separator connected between the pump and the one or more heat exchangers; (4) a second pump connected between the solids separator and the one or more heat exchangers; or (5) a second heat exchanger connected between the pump and the dynamic heat generator to transfer heat from the prime mover to the water before the water is heated by the dynamic heat generator. The first and second filters may include one or more carbon-based filters, one or more sand-based filters, one or more screens or a combination thereof. The solids separator may include one or more filters, one or more screens, a hydrocyclone or a combination thereof. The system can be portable.

Now referring to FIG. 1, a flameless hot water system 10 for killing pathogens and other contaminants, in accordance with a particular embodiment is shown. In system 10, water is pumped from a raw water supply 11 to a solids separator 14 using a pump 12. In particular embodiments, solids separator 14 may include one or more filters, one or more screens, a hydrocyclone or a combination thereof. For example, a hydrocyclone spins the received water within a chamber to force solids out in a centrifugal manner. In particular embodiments, solids separator 14 may filter out solids as small as three microns.

The clarified water exits the solids separator, or hydrocyclone, at the top of the separator and is pumped by pump 16 to a filter 18. Filter 18 may include any suitable filter type, such as one or more carbon-based filters, one or more sand-based filters, one or more screens or a combination thereof. Some embodiments may not include a filter 18 to which the water clarified at solids separator 14 is pumped.

After passing through filter 18, the water enters heat exchangers 20, 22 and 24 which add heat to the incoming water. Heat exchangers 20, 22 and 24 may include a plurality of pipes within a tube. Water flowing in the direction indicated by arrow 21 passes through the pipes and is heated by warmer water flowing 15 outside the pipes in the opposite direction.

After leaving heat exchanger 24, the water continues to heater 26 which includes a dynamic heat generator. The dynamic heat generator can heat the water any suitable amount (specified temperature) to kill pathogens and other contaminants. The difference in temperature between water coming into the dynamic heat generator and water leaving the dynamic heat generator may be modified by controlling the flow. For example, if the flow is restricted and the water stays within dynamic heat generator 26 longer, then the difference in temperature between incoming and outgoing water is greater. Similarly, if the flow rate increased, then the difference in temperature between incoming and outgoing water is lower.

In particular embodiments, the dynamic heat generator is approximately twelve inches in diameter and six inches in width. In some embodiments it is made of aluminum, although it can be constructed from other materials in other embodiments. In particular embodiments, the dynamic heat generator may be similar or identical to an Island City, LLC dynamic heat generator. The dynamic heat generator may consist of only two moving parts. Running an engine around 1800 RPMs spins the dynamic heat generator which causes internal wheels to rotate and compress the water molecules flowing therethrough, thereby causing friction that produces heat. The power source for the system can be an engine or electrical motor. In some embodiments, a sixty-six horse power diesel engine is used as the power source. Attached to the drive shaft of the engine is the dynamic heat generator.

In the illustrated embodiment, diesel engine 28 is used to drive heater 26. Diesel engine 28 includes heat exchanger 31 through which water is pumped by pump 30. Thus, heat produced by the work performed by diesel engine 28, for example in the engine jacket water, is used to heat water flowing into heat exchanger 21. Pump 30 pumps, to heat exchanger 31, the water that is used to heat the water flowing in the direction of arrow 21 in heat exchanger 22. Therefore, a loop is created to maximize use in the system of heat produced by the diesel engine.

After exiting the dynamic heat generator, the water flows in the direction of arrow 27 back through heat exchanger 24 (e.g., outside the pipes through which the incoming water flowing along direction 23 into heat exchanger 24 passes). This warmer water from the dynamic 30 heat generator that flows outside the pipes of heat exchanger 24 warms the water flowing into the heat exchanger. Thus, after pathogens and other contaminants are killed by the heating of the water by dynamic heat generator 26, the heat is recovered for use in heat exchanger 24 to add efficiency to the system.

After exiting heat exchanger 24, the water flows in the direction indicated by arrow 29 back to heat exchanger 20 to aid in warming the water entering heat exchanger 20 from filter 18. The water leaves heat exchanger 20 and flows to filter 32, check valve 34, gauge 36 and valve 38. In some cases, if filter 32 gets clogged for example, pressure may increase at check valve 40 such that the valve releases to allow the water to flow back into water supply 11. Filter 32 may be useful to remove harmful contaminants post-distillation, such as arsenic.

The flow of water exiting system 10 through valve 38 may be controlled. In some cases, the water may exit at approximately 15 gallons per minute. In some embodiments, system 10 may consume, as a rule of thumb, one gallon of fuel, per twenty horse power, per hour per 1,000 gallons of processed water. As indicated above, by controlling the water flow and the power driving the dynamic heat generator, the water flowing through the system may be heated to any suitable temperature to kill pathogens and other contaminants. For example, in some embodiments the water may be heated to 220 degrees Fahrenheit, and approximately 5 kW of electrical power may be generated.

When a distillation process is required, two steps in addition to those described with respect to FIG. 1 may be utilized. Rather than circulating water directly through dynamic heat generator 26, a heat transfer liquid may be run in a closed loop to generate the desired level of temperature. This heat transfer liquid is run through the inside of a heat exchanger and water is run through the outside of the heat exchanger. This step prevents potential damage to the seal in the dynamic heat generator due to abrasive properties from the salt water. The second modification is the addition of a second hydrocyclone. The heated water flows out of the heat exchanger and runs directly into the hydrocyclone. As the hot water spins in the hydrocyclone, a vacuum is created causing the water to flash to steam. The remaining "salt slurry" drops out of the bottom of the hydrocyclone into a holding tank. The steam may then run through a liquid separator into a holding tank.

For example, the present invention provides a system for desalinating saltwater using a prime mover (e.g., an engine, a turbine, an electric motor, a hydraulic motor or a combination thereof), a closed loop (dynamic heat generator, a first pump and a first heat exchanger), a second pump and a hydrocyclone. The dynamic heat generator is driven by the prime mover to heat a heat transfer liquid to a least the specified temperature without a flame. The first heat exchanger connected to the second pump such that such that the heated heat transfer liquid from the dynamic heat generator is used to heat the saltwater from the second pump. The hydrocyclone is connected to the first heat exchanger, receives the heated saltwater and substantially separates the heated saltwater into desalinated water and a salt slurry. The system may also include: (1) a source of saltwater connected to the second pump; (2) a first storage that receives the desalinated water; (3) a second storage that receives the salt slurry; (4) a second heat exchanger connected between the second pump and the first heat exchanger to transfer heat from the prime mover to the saltwater before the saltwater is heated by the first heat exchanger; or (5) a third heat exchanger connected between the hydrocyclone and the first storage to transfer heat from the desalinated water to the saltwater before the saltwater is heated by the first heat exchanger. The system can be portable.

Figure 2:
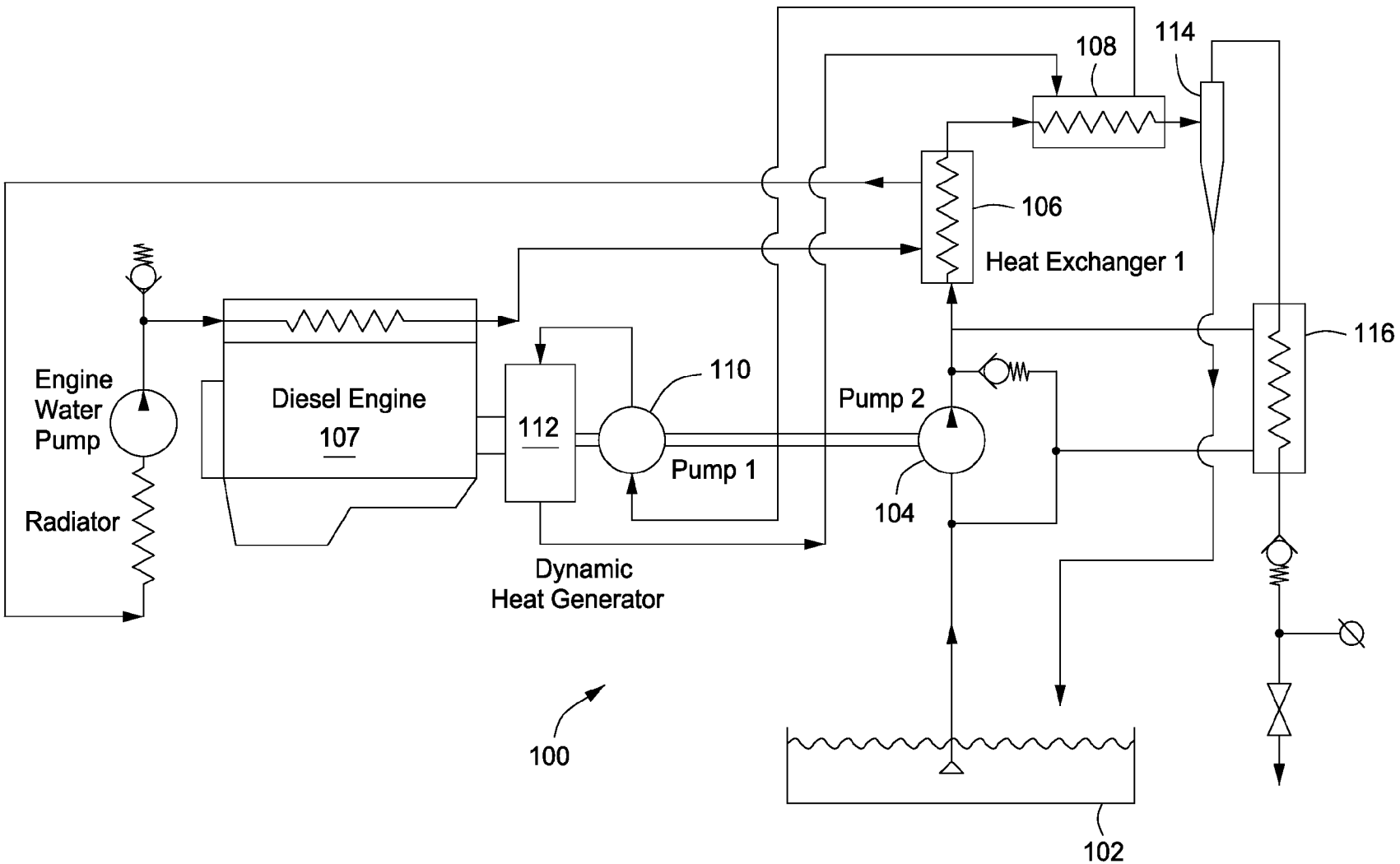
FIG. 2 illustrates a flameless hot water system for the distillation of salt water, in accordance with a particular embodiment

Referring now to FIG. 2, a flameless hot water system 100 for the distillation of salt water, in accordance with a particular embodiment is shown. Water is pumped from water source 102 using pump 104. The water flows through heat exchanger 106 for preheating. The outside of heat exchanger 106 (e.g., the heating element) may comprise water glycol from a diesel engine 107. The water may then flow through the inside of heat exchanger 108 for superheating (e.g., to at least 212 degrees Fahrenheit in some embodiments). The outside of heat exchanger 108 may comprise a heat transfer fluid (e.g., dynalene) circulated by pump 110 through dynamic heat generator 112 to reach a high temperature, such as approximately 300 degrees Fahrenheit.

The superheated water then flows into hydrocyclone 114 where a vacuum is created. At this point, the superheated water flashes to steam and escapes through the top of hydrocyclone 114. The water that does not flash to steam and the salt that has been separated in the flashing process will flow out of the bottom of hydrocyclone 114 to return to water source 102 or other capturing tanks as desired. The water that has flashed to steam flows through the inside of heat exchanger 116 to be cooled by ambient water such that it is condensed back to a purified liquid state.

In another example, the present invention provides a system for melting paraffin in an oil well using a prime mover (e.g., an engine, a turbine, an electric motor, a hydraulic motor or a combination thereof), a water storage unit, a dynamic heat generator and a valve. The dynamic heat generator is driven by the prime mover and is connected to or disposed within the water storage unit to heat the water to a least a specified temperature without a flame. The valve connects the dynamic heat generator to the water storage unit and the oil well such that the heated water is circulated to the water storage until the heated water in the water storage reaches a temperature sufficient to melt the paraffin and the heated water is pumped into the oil well. The system may also include: (1) a heat exchanger connected between the pump and the dynamic heat generator to transfer heat from the prime mover to the water before the water is heated by the dynamic heat exchanger; or (2) a pump connected between the water storage unit and the dynamic heat generator. The system can be portable.

Figure 3:
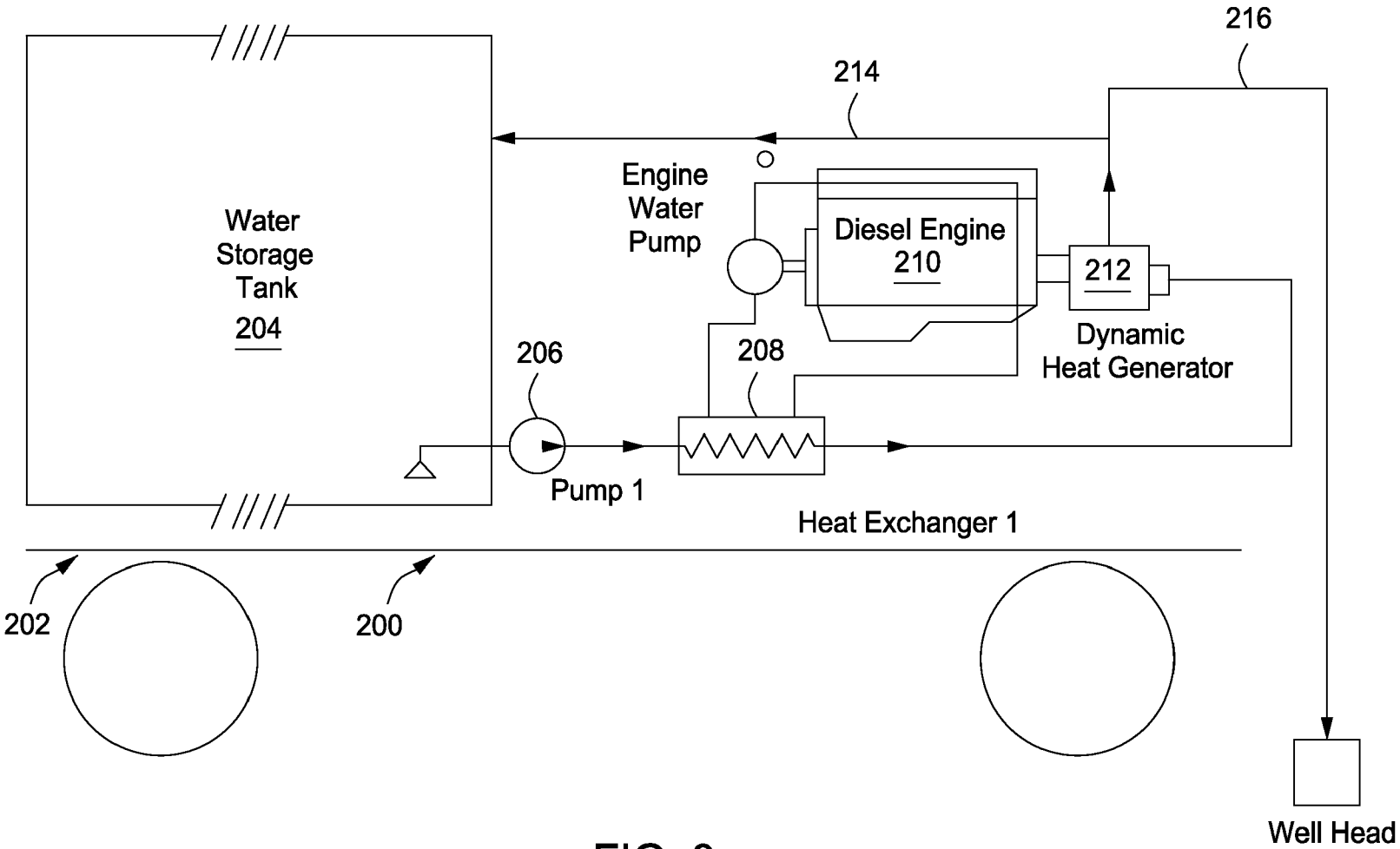
FIG. 3 illustrates a portable flameless hot water system for on site treatment of paraffin clogging used in the oil field service industry, in accordance with a particular embodiment.

Now referring to FIG. 3, a portable flameless hot water system 200 for on site treatment of paraffin clogging used in the oil field service industry, in accordance with a particular embodiment is shown. As a way of heating water high enough to melt down hole paraffin, a system has be designed to perform this function either on site or by mounting the system on a truck for mobility. For example, by mounting the system described in FIG. 1 on a truck and using water stored in a seventy-five barrel tank, a line is run from the water tank directly to the water heating system. As the water circulates through a dynamic heat generator, it is sent back to the water tank until the water reaches a temperature of 250 degrees Fahrenheit. Once that temperature is reached the water is then sent down hole through the well head for the paraffin melting process.

As illustrated, system 200 is mounted on truck 202 for mobility. Water is pumped using pump 206 from a baffled water storage tank 204 mounted on the truck bed. The water flows through the inside of heat exchanger 208 for preheating. As is the case in other embodiments, the preheating process increase's the efficiency of the system and takes advantage of otherwise unused energy. In particular embodiments, the outside of heat exchanger 208 may comprise water glycol from the cooling system of engine 210. The water then flows through dynamic heat generator 212 for superheating. The water is then piped back into water storage tank 204 (e.g., along piping 214). The process continues in a loop fashion until the water in storage tank 204 reaches a certain desired temperature (e.g., approximately 212 or 250 degrees Fahrenheit in some embodiments). At this point, the super hot water is released along line 216 directly into the well head and down the perforation where the paraffin is treated.

Figure 4:
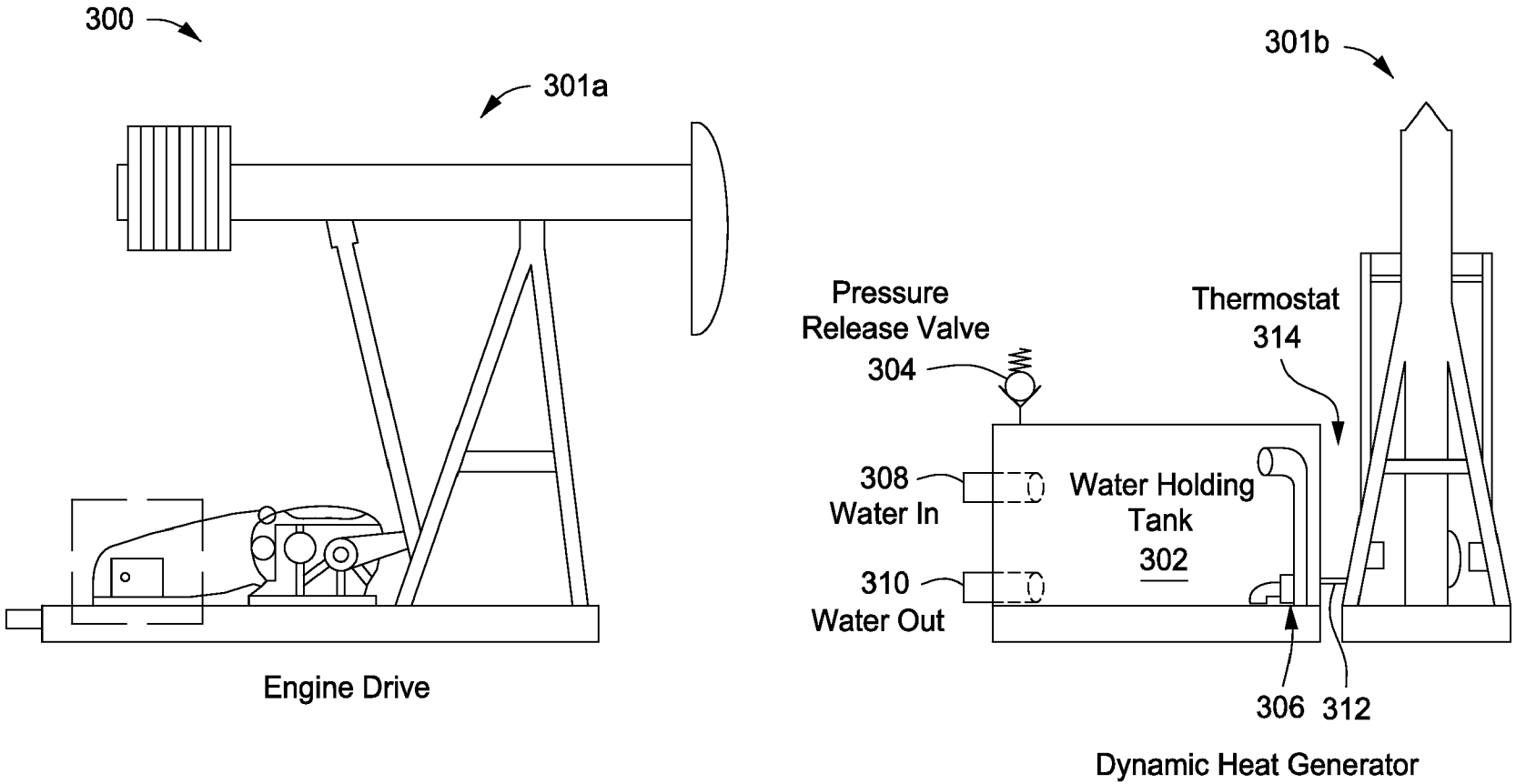
FIG. 4 illustrates a permanent on site flameless hot water system for paraffin clogging used in the oil field service industry, in accordance with a particular embodiment.

Referring now to FIG. 4, a permanent on site flameless hot water system 300 for paraffin clogging used in the oil field service industry, in accordance with a particular embodiment is shown. FIG. 4 includes a side view 301*a* and an end view 301*b* of system 300. Water is stored next to the well head in a sealed steel pressure vessel 302 with a pressure release valve 304. A dynamic heat generator 306 may be installed inside sealed steel vessel 302 with an input pipe 308 and an exit pipe 310 attached 20 to allow for the flow of water. A drive shaft 312 is extended from the pump jack electrical motor to dynamic heat generator 306.

When the pump jack has completed its time cycle to pump oil, the electric motor turns off. Operated by a timer, the electric motor reverses its rotation and becomes the power source for dynamic heat generator 306 by way of an overrunning clutch and drive shaft. The overrunning clutch mounted under the pump jacks sheave prevents the pump jack from operating thus allowing the electric motor to be used as the power source for spinning dynamic heat generator 306. Water is circulated in steel vessel 302 until it reaches a desired temperature, such as approximately 250 degrees Fahrenheit. At this time, a thermostat 314 releases the hot water back down hole allowing the hot water to clean the perforation holes that are clogged with paraffin. In particular embodiments, this process may be done without any flames.

Figure 5:
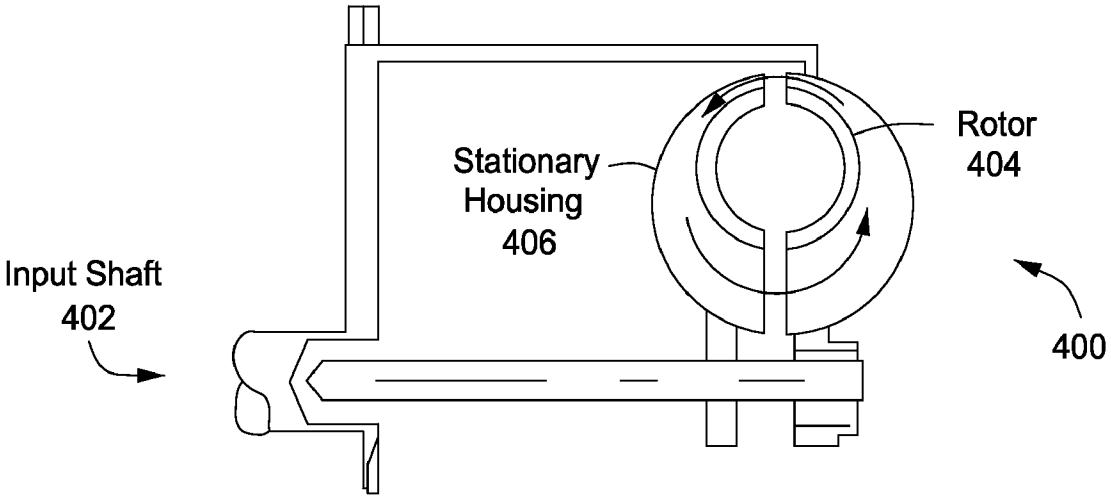
FIG. 5 illustrates an example dynamic heat generator for use in various applications, in accordance with a particular embodiment.

FIG. 5 illustrates an example dynamic heat generator 400 for use in various applications, in accordance with a particular embodiment. For example, dynamic heat generator 400 may be used as the dynamic heat generator of various applications described herein. Dynamic heat generator 400 is a hydrodynamic device that takes rotational energy provided by a prime mover (diesel engine, electric motor, hydraulic motor, etc.) from a relatively low velocity near its center to a high velocity at its outer diameter creating kinetic energy (heat) in the fluid.

Power, created by the prime mover, is absorbed following basic laws of centrifugal pumps. For example, power capacity is proportional to the input speed to the third power, and power capacity is proportional to the rotors diameter to the fifth power.

Structurally, dynamic heat generator comprises a rotor 404 with radial vanes and a stationary housing 406 with matching radial vanes. Fluid enters dynamic heat generator 400 at an input shaft 402. As rotor 404 turns, the fluid carried by the blades is under the influence of various tangential forces. A fluid head is created which transfers the liquid from the rotor 404 vanes to the vanes in stationary housing 406. The result is the fluid flowing at a maximum velocity and the creation of kinetic energy (heat).

In operation, working fluids are pumped into dynamic heat generator 400 where the fluid is effectively heated through hydrodynamic action and is then provided as a feedstock for a variety of process requirements such as water purification and distillation.

Various applications of particular embodiments may include heating water in excess of 212 degrees Fahrenheit to kill pathogens, flashing hot water to steam for desalination of contaminated or salt water, generating on board potable water from a vehicle's air brakes, exhausts, air condition condensation or external opportunistic water sources, producing radiant heat in pipes for habitat heating, melting ice and snow, heating portable showers, cooking, de-icing aircraft, heating hot tubs and swimming pools, steam reforming of petroleum fuels for production of hydrogen use in fuel cells for hybrid vehicles, melting paraffin in down hole tubing, and heating water for carwashes and home appliances (dishwashers, hot water heaters, washing machines).

Although the present invention has been described in detail with reference to particular embodiments, it should be understood that various other changes, substitutions, and alterations may be made hereto without departing from the spirit and scope of the present invention. For example, although the present invention has been described with reference to a number of components included within various systems, these components may be combined, rearranged, re-sized or positioned in order to accommodate particular needs and applications. The present invention contemplates great flexibility in the arrangement of these elements as well as their internal components.

For example, some embodiments may utilize an engine or mechanism other than a diesel engine to drive the dynamic heat generator. Depending on particular needs and applications, particular embodiments may not utilize one or more components such as one or more of the illustrated heat exchangers, filters and pumps. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A system for heating water to at least a specified temperature without a flame comprising:

a prime mover;

a pump;

a dynamic heat generator driven by the prime mover to heat the water to a least the specified temperature without a flame, wherein the prime mover drives two or more internal wheels within the dynamic heat generator to rotate and compress the water causing friction that heats the water passing through the dynamic heat generator, and the specified temperature is controlled by adjusting a flow rate of the water entering the dynamic heat generator and/or a speed of the prime mover; and one or more heat exchangers connected to the pump and the dynamic heat generator such that the heated water from the dynamic heat generator is provided to an output and is used to pre-heat the water from the pump before the water is heated by the dynamic heat generator.

2. The system as recited in claim 1, wherein the specified temperature is greater than or equal to 212 degrees Fahrenheit, or is greater than a temperature required to kill pathogens within the water, or is greater than or equal to 250 degrees Fahrenheit, or is greater than or equal to 300 degrees Fahrenheit, or is greater than or equal to a temperature required to desalinate saltwater, or is greater than or equal to a temperature required to melt paraffin, or is greater than or equal to a temperature required to create steam.

3. The system as recited in claim 1, wherein the prime mover comprises an engine, a turbine, an electric motor, a hydraulic motor or a combination thereof.

4. The system as recited in claim 1, wherein the pump is connected to a source of water.

5. The system as recited in claim 1, further comprising:

a first filter connected between the pump and the one or more heat exchangers; or a second filter connected between the one or more heat exchangers and the output.

6. The system as recited in claim 5, wherein the first and second filters comprise one or more carbon-based filters, one or more sand-based filters, one or more screens or a combination thereof.

7. The system as recited in claim 1, further comprising a solids separator connected between the pump and the one or more heat exchangers.

8. The system as recited in claim 7, wherein the solids separator comprises one or more filters, one or more screens, a hydrocyclone or a combination thereof.

9. The system as recited in claim 8, further comprising a second pump connected between the solids separator and the one or more heat exchangers.

10. The system as recited in claim 1, further comprising a second heat exchanger connected between the pump and the dynamic heat generator to transfer heat from the prime mover to the water before the water is heated by the dynamic heat generator.

11. The system as recited in claim 1, wherein the heated water is used to produce electricity, provide radiant heat, provide drinking water, melt paraffin in an oil well, produce steam, or produce steam to reform a petroleum fuel to produce hydrogen for use in a fuel cell.

12. The system as recited in claim 1, wherein the system is portable.

13. The system as recited in claim 1, wherein the dynamic heat generator comprises:

a stationary housing having an input, an output, and a first set of radial vanes within the stationary housing; and a rotor disposed within the stationary housing having a second set of radial vanes.

14. A system for desalinating saltwater comprising:

a prime mover;

a closed loop comprising a dynamic heat generator driven by the prime mover to heat a heat transfer liquid to a least the specified temperature without a flame, a first pump and a first heat exchanger, wherein the prime mover drives two or more internal wheels within the dynamic heat generator to rotate and compress the saltwater causing friction that heats the saltwater passing through the dynamic heat generator, and the specified temperature is controlled by adjusting a flow rate of the saltwater entering the dynamic heat generator and/or a speed of the prime mover;

a second pump;

the first heat exchanger connected to the second pump such that the heated heat transfer liquid from the dynamic heat generator is used to heat the saltwater from the second pump; and a hydrocyclone connected to the first heat exchanger that receives the heated saltwater and substantially separates the heated saltwater into desalinated water and a salt slurry.

15. The system as recited in claim 14, wherein the specified temperature is greater than or equal to 212 degrees Fahrenheit, or is greater than or equal to 250 degrees Fahrenheit, or is greater than or equal to 300 degrees Fahrenheit, or is greater than or equal to a temperature required to desalinate saltwater, or is greater than or equal to a temperature required to create steam.

16. The system as recited in claim 14, wherein the prime mover comprises an engine, a turbine, an electric motor, a hydraulic motor or a combination thereof.

17. The system as recited in claim 14, further comprising:

a source of saltwater connected to the second pump;

a first storage that receives the desalinated water; or a second storage that receives the salt slurry.

18. The system as recited in claim 14, further comprising:

a second heat exchanger connected between the second pump and the first heat exchanger to transfer heat from the prime mover to the saltwater before the saltwater is heated by the first heat exchanger; or a third heat exchanger connected between the hydrocyclone and the first storage to transfer heat from the desalinated water to the saltwater before the saltwater is heated by the first heat exchanger.

19. The system as recited in claim 14, wherein the dynamic heat generator comprises:

a stationary housing having an input, an output, and a first set of radial vanes within the stationary housing; and a rotor disposed within the stationary housing having a second set of radial vanes.

20. The system as recited in claim 14, wherein the system is portable.

21. A system for melting paraffin in an oil well comprising:

a prime mover;

a water storage unit;

a dynamic heat generator driven by the prime mover and connected to or disposed within the water storage unit to heat the water to a least a specified temperature without a flame, wherein the prime mover drives two or more internal wheels within the dynamic heat generator to rotate and compress the water causing friction that heats the water passing through the dynamic heat generator, and the specified temperature is controlled by adjusting a flow rate of the water entering the dynamic heat generator and/or a speed of the prime mover; and a valve connecting the dynamic heat generator to the water storage unit and the oil well such that the heated water is circulated to the water storage until the heated water in the water storage reaches a temperature sufficient to melt the paraffin and the heated water is pumped into the oil well.

22. The system as recited in claim 21, wherein the specified temperature is greater than or equal to 250 degrees Fahrenheit, or is greater than or equal to 300 degrees Fahrenheit, or is greater than or equal to a temperature required to create steam, or is greater than or equal to a temperature required to melt paraffin.

23. The system as recited in claim 21, wherein the prime mover comprises an engine, a turbine, an electric motor, a hydraulic motor or a combination thereof.

24. The system as recited in claim 21, further comprising a heat exchanger connected between the pump and the dynamic heat generator to transfer heat from the prime mover to the water before the water is heated by the dynamic heat exchanger.

25. The system as recited in claim 21, further comprising a pump connected between the water storage unit and the dynamic heat generator.

26. The system as recited in claim 21, wherein the dynamic heat generator comprises:

a stationary housing having an input, an output, and a first set of radial vanes within the stationary housing; and a rotor disposed within the stationary housing having a second set of radial vanes.

27. The system as recited in claim 21, wherein the system is portable.

* * * * *

UNITED STATES PATENT AND TRADEMARK OFFICE

CERTIFICATE OF CORRECTION

PATENT NO. : 7,866,380 B2
APPLICATION NO. : 11/398828
DATED : January 11, 2011
INVENTOR(S) : W. James Masters et al.

It is certified that error appears in the above-identified patent and that said Letters Patent is hereby corrected as shown below:

Col. 8, line 53
Replace "increase's the efficiency" with --increases the efficiency--

Claim 9: Col. 11, line 1
Replace "as recited in claim 8" with --as recited in claim 1--

Signed and Sealed this
Thirteenth Day of September, 2011

David J. Kappos

David J. Kappos
*Director of the United States Patent and Trademark Office*